US011264741B2

(12) United States Patent
Goto

(10) Patent No.: US 11,264,741 B2
(45) Date of Patent: Mar. 1, 2022

(54) PRESS-FIT TERMINAL

(71) Applicant: Sumitomo Wiring Systems, Ltd., Yokkaichi (JP)

(72) Inventor: Hideki Goto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 16/969,967

(22) PCT Filed: Jan. 24, 2019

(86) PCT No.: PCT/JP2019/002235
§ 371 (c)(1),
(2) Date: Aug. 13, 2020

(87) PCT Pub. No.: WO2019/159628
PCT Pub. Date: Aug. 22, 2019

(65) Prior Publication Data

US 2020/0412035 A1 Dec. 31, 2020

(30) Foreign Application Priority Data

Feb. 14, 2018 (JP) ..... JP2018-024375

(51) Int. Cl.

| | |
|---|---|
| ***H01R 12/50*** | (2011.01) |
| ***H01R 12/58*** | (2011.01) |
| ***H01R 4/10*** | (2006.01) |
| ***H01R 13/04*** | (2006.01) |

(52) U.S. Cl.
CPC ..... *H01R 12/585* (2013.01); *H01R 4/10* (2013.01); *H01R 13/04* (2013.01)

(58) Field of Classification Search
CPC ..... H01R 12/585; H01R 12/58; H01R 12/55; H01R 12/52; H01R 12/51; H01R 12/50; H01R 4/10; H01R 13/04; H01R 13/02
USPC ..... 439/81, 82, 751
See application file for complete search history.

(56) References Cited

U.S. PATENT DOCUMENTS

| | | | | |
|---|---|---|---|---|
| 4,186,982 A * | 2/1980 | Cobaugh | ..... | H01R 12/58 439/444 |
| 4,557,539 A * | 12/1985 | Zust | ..... | H01R 12/58 439/84 |
| 5,035,656 A * | 7/1991 | Patel | ..... | H01R 12/58 439/733.1 |

(Continued)

FOREIGN PATENT DOCUMENTS

| | | |
|---|---|---|
| EP | 0043749 B1 | 9/1984 |
| JP | H10-241760 A | 9/1998 |

(Continued)

OTHER PUBLICATIONS

International Search Report, Application No. PCT/JP2019/002235, dated Apr. 16, 2019. ISA/Japan Patent Office.

*Primary Examiner* — Harshad C Patel
(74) *Attorney, Agent, or Firm* — Honigman LLP

(57) ABSTRACT

A press-fit terminal includes a press-fit portion to be inserted into a through hole of a circuit board. The press-fit portion includes a plurality of protruding portions extending outward from a cross-sectional center of the press-fit portion, and a distance between an outer edge of each of the protruding portions and the cross-sectional center is continuously decreased toward the distal end of the press-fit portion.

5 Claims, 5 Drawing Sheets

(56) References Cited

U.S. PATENT DOCUMENTS 5,139,466 A * 8/1992 Perry ..... F16H 37/086 475/191
5,487,684 A * 1/1996 Schalk ..... H01R 12/585 439/751
5,692,928 A * 12/1997 Nelson ..... H01R 13/41 439/733.1
5,897,401 A * 4/1999 Fili ..... H01R 13/41 439/733.1
6,149,471 A * 11/2000 Kemp ..... H01R 13/41 439/444
6,152,782 A * 11/2000 Volkert ..... H01R 13/41 439/733.1
7,249,981 B2 * 7/2007 Chen ..... H01R 12/585 439/751
7,255,612 B2 * 8/2007 Noguchi ..... H01R 12/585 439/751
D551,623 S * 9/2007 Lee ..... H01R 12/585 D13/133
7,377,823 B2 * 5/2008 Chen ..... H01R 12/585 439/751
8,371,871 B1 * 2/2013 Murphy ..... H01R 12/585 439/444
8,888,541 B2 * 11/2014 Endo ..... H01R 12/585 439/751
9,172,166 B2 * 10/2015 Kida ..... H01R 13/40
9,300,059 B2 * 3/2016 Endo ..... H01R 12/585
9,595,782 B2 * 3/2017 Farole ..... H01R 13/41
9,728,869 B2 * 8/2017 Goto ..... H05K 3/3447
10,236,603 B2 * 3/2019 Goto ..... H01R 12/585
2006/0035535 A1 * 2/2006 Kawahara ..... H01R 12/585 439/751
2007/0010139 A1 * 1/2007 Chen ..... H01R 12/585 439/751
2008/0227315 A1 * 9/2008 Banno ..... H01R 12/58 439/82
2011/0201237 A1 * 8/2011 Suzuki ..... H01R 12/585 439/884
2012/0297852 A1 * 11/2012 Sakamoto ..... H01R 43/16 72/339
2016/0359257 A1 * 12/2016 Chiba ..... H01R 13/41
2018/0123267 A1 5/2018 Goto

FOREIGN PATENT DOCUMENTS

JP 2014-220092 A 11/2014
JP 2017-004670 A 1/2017

* cited by examiner

PRESS-FIT TERMINAL

CROSS-REFERENCE TO RELATED APPLICATIONS

This application is the U.S. national stage of PCT/JP2019/002235 filed on Jan. 24, 2019, which claims priority of Japanese Patent Application No. 2018-024375 filed on Feb. 14, 2018, the contents of which are incorporated herein.

TECHNICAL FIELD

This disclosure relates to a press-fit terminal that is press-fitted into a through hole of a circuit board.

BACKGROUND

For electrical connection between an electronic component mounted on a circuit board and an electronic component outside the circuit board, press-fit connection in which a terminal (a press-fit terminal) slightly larger than a through hole provided in the circuit board is press-fitted into the through hole may be employed. The press-fit terminal is required to be firmly held in the through hole with a simple configuration.

The press-fit terminal disclosed in JP 2014-220092A includes a press-fit portion that is connected to a rod-shaped main body portion, and that is press-fitted into a through hole of a circuit board. The press-fit portion has a plurality of contact pieces protruding outward in a rib shape from the cross-sectional center of the press-fit portion. The press-fit portion is formed in a spindle shape, and the protruding length of each contact piece is, with respect to the longitudinal direction of the press-fit portion, gradually increased from the base end, maximized at the center, and gradually decreased toward the distal end.

As described above, the press-fit portion of the press-fit terminal of JP 2014-220092A has a spindle shape, and the center portion of the press-fit portion where the protruding length of the contact piece is longest is most strongly pressed against the inner peripheral surface of the through hole. When the press-fit portion is formed in a spindle shape, it is necessary to strictly control the dimensional tolerances of the contact pieces. If the dimensions of the contact pieces are too large for the through hole, the contact pieces damage the inner peripheral surface of the through hole, and if the dimensions are too small, the holding force of the contact pieces to the through hole is insufficient.

An object of the present disclosure is to provide a press-fit terminal that realizes a stable holding force with a simple configuration.

SUMMARY

A press-fit terminal according to one aspect of the present disclosure is a press-fit terminal including a press-fit portion to be press-fitted into a through hole of a circuit board, wherein the press-fit portion includes a plurality of protruding portions extending outward from a cross-sectional center of the press-fit portion, and a distance between an outer edge of each of the protruding portions and the cross-sectional center is continuously decreased toward the distal end of the press-fit portion.

First, embodiments of the present disclosure will be listed and described. Further, at least some of the embodiments described below may be optionally combined.

A press-fit terminal according to one aspect of the present disclosure is a press-fit terminal including a press-fit portion to be press-fitted into a through hole of a circuit board, wherein the press-fit portion includes a plurality of protruding portions extending outward from a cross-sectional center of the press-fit portion, and a distance between an outer edge of each of the protruding portions and the cross-sectional center is continuously decreased toward a distal end of the press-fit portion.

In one aspect of the present disclosure, because the distance of the outer edge of the protruding portion from the cross-sectional center is continuously decreased toward the distal end, the distance from the cross-sectional center to the outer edge on the base end side can be designed to be sufficiently larger than the inner diameter of the through hole.

In the press-fit terminal according to one aspect of the present disclosure, a cross section of the press-fit portion on a distal end portion side has a polygonal shape corresponding to the number of protruding portions.

According to one aspect of the present disclosure, the press-fit portion can be shaped by forging the side surfaces of the rod-shaped material having a polygonal shape with a mold or the like. Also, by forming the protruding portions at positions corresponding to the side edges of the polygonal shape, processing can be simplified. By simplifying the processing, even when a plating layer is formed on the surface before the processing, the influence on the plating layer can be reduced.

In the press-fit terminal according to one aspect of the present disclosure, the cross section of the press-fit portion is cross-shaped on a base end side and substantially square on the distal end side.

According to one aspect of the present disclosure, it is easy to form the press-fit portion from a rod-shaped material having a substantially square cross section.

In the press-fit terminal according to one aspect of the present disclosure, a ridge line of the protruding portions is in a twisted position with respect to an axis of the press-fit portion.

According to one aspect of the present disclosure, because the ridge line connecting the top portions of the protruding portions is in a twisted position with respect to the axis of the press-fit portion, the protruding portions easily collapse at the time of press-fitting, and damage to the through hole can be reduced.

In the press-fit terminal according to one aspect of the present disclosure, the protruding portions are formed between recessed portions that increase in depth and width from the distal end toward a base portion of the press-fit portion.

According to one aspect of the present disclosure, due to the recessed portions that are deeper and wider from the distal end toward the base end, the closer to the base end, the longer the protruding lengths of the protruding portions become and the more easily the protruding portions collapse and damage to the through hole can be reduced.

Effects of Present Disclosure

According to the above press-fit terminal, a more stable holding force can be exhibited with a simple configuration, and yield can be improved.

DETAILED DESCRIPTION OF PREFERRED EMBODIMENTS

A specific example of a press-fit terminal according to embodiments of the present disclosure will be described with reference to the drawings. Note that the present disclosure is not limited to these illustrative examples, but is indicated by the claims, and is intended to include all modifications within the scope and the meaning equivalent to the claims.

Figure 1:
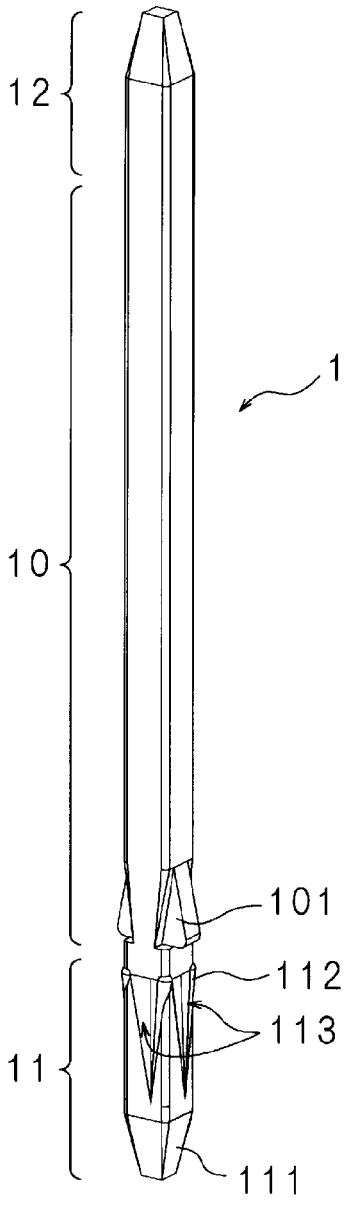
FIG. 1 is a perspective view of a press-fit terminal according to an embodiment of the present disclosure.
Figure 2:
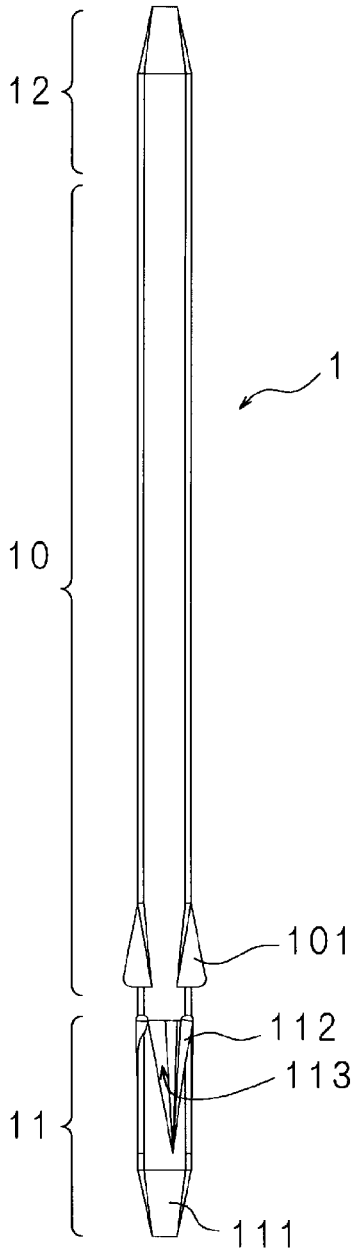
FIG. 2 is a front view of the press-fit terminal according to the embodiment.
Figure 3:
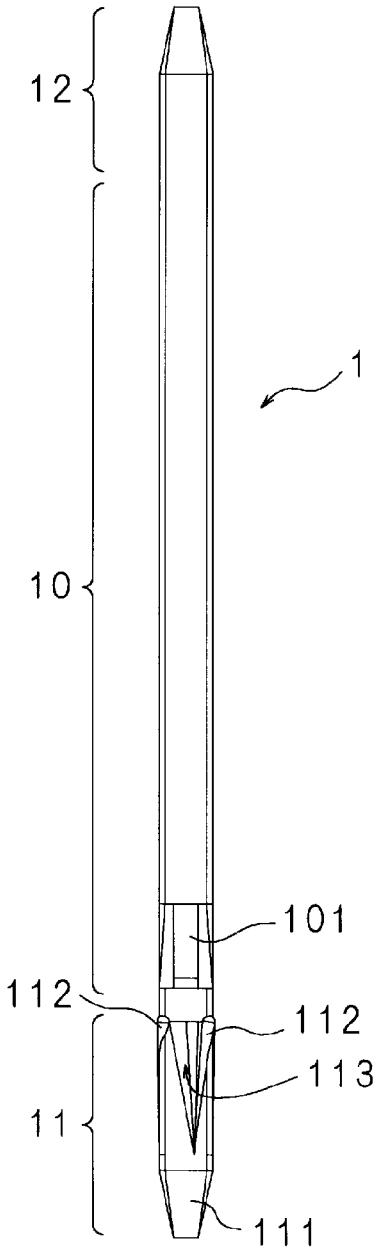
FIG. 3 is a side view of the press-fit terminal according to the embodiment.

FIG. 1 is a perspective view of a press-fit terminal 1 according to an embodiment of the present disclosure, FIG. 2 is a front view, and FIG. 3 is a side view thereof. The press-fit terminal 1 is a component that is connected to a connector portion of an electronic device or the like (not shown), and includes a main body portion 10, a connection portion 12, and a press-fit portion 11. The main body portion 10, the connection portion 12, and the press-fit portion 11 are all made of conductive metal.

The main body portion 10 has a rod shape and a substantially square cross section. The connection portion 12 is connected to one end of the main body portion 10 and has the same cross section as the main body portion 10. The distal end of the connection portion 12 from the main body portion 10 is beveled. The press-fit terminal 1 is electrically connected to the connection portion of the electronic device via the connection portion 12.

At the opposite end of the main body portion 10 to the connection portion 12, a shoulder portion 101 protruding from each of the two opposing surfaces are provided. The shoulder portions 101 each have a surface that is orthogonal to the length direction of the main body portion 10, on the distal side from the connection portion 12.

Figure 4A:
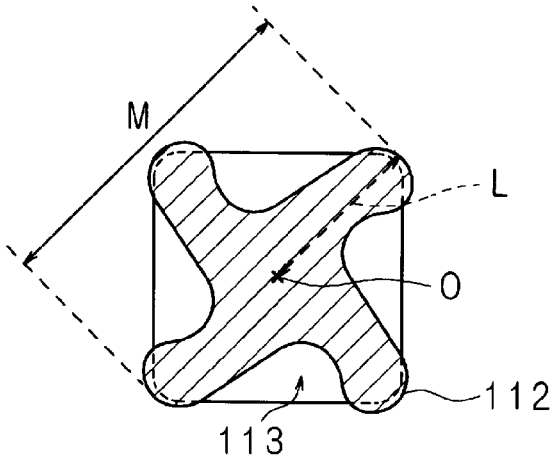
FIG. 4A is a cross-sectional view of a press-fit portion.
Figure 4B:
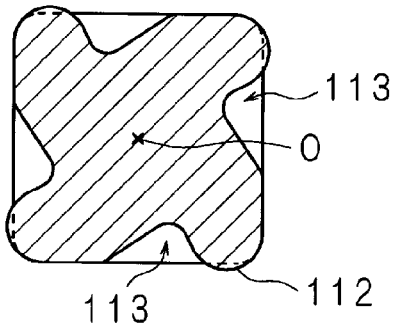
FIG. 4B is a cross-sectional view of the press-fit portion.
Figure 4C:
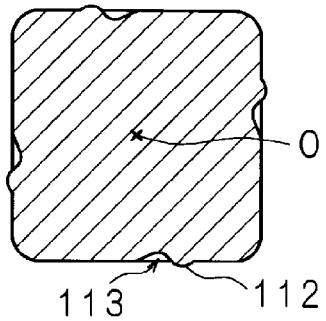
FIG. 4C is a cross-sectional view of the press-fit portion.
Figure 4D:
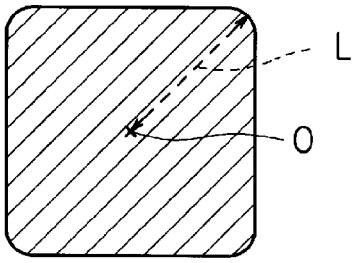
FIG. 4D is a cross-sectional view of the press-fit portion.

The press-fit portion 11 is connected to the other end of the main body portion 10. The cross-sectional shape of the press-fit portion 11 is not uniform, and continuously changes from the base portion continuous with the main body portion 10 toward the distal end portion. Further, tapered surfaces 111 each having a reduced distal end are formed at the distal end portion. FIGS. 4A, 4B, 4C, and 4D are cross-sectional views of the press-fit portion 11. Note that FIGS. 4A to 4D show changes in the cross-sectional shape at four positions in the length direction of the press-fit portion 11 in order from the base portion toward the distal end. As shown in FIG. 4D, the distal end portion of the press-fit portion 11 has a square cross section in which the four corners are rounded. As shown in FIG. 4A, the base portion of the press-fit portion 11 has a substantially cross-shaped cross section in which a portion close to a corner portion from the center of each side of the cross section shown in FIG. 4D is recessed (a recessed portion 113), and each corner portion is protruded outward to provide four protruding portion 112. FIGS. 4B and 4C show cross sections of the intermediate portion. The line connecting the top portions of the protruding portions 112 in each of the cross sections shown in FIGS. 4A to 4D, that is, the ridge line, is in a twisted position with respect to the axis of the press-fit portion 11, as shown in FIG. 1. In addition, the depth and width of the recessed portions 113 formed by recessing each side of the cross section increase from the distal end (FIG. 4D) toward the base portion (FIG. 4A) of the press-fit portion 11.

Note that the number of protruding portions 112 is not limited to four, and may be three or more. When the number of protruding portions 112 is three, the cross section on the distal end portion side is a triangle, and when the number is five, the cross section is a pentagon.

The press-fit portion 11 is formed, for example, as follows. For example, a rod-shaped base material obtained by cutting a metal wire having a substantially square cross section into a predetermined length is used. The press-fit portion 11 is formed through forging by pressing a mold having corner portions corresponding to the shape of the recessed portions 113 at a position deviated to one side from the center of the each side of the cross section of the rod-shaped base material from four directions so that the pressing depth on base portion side is deep. As described above, the portions with which the corner portions are in contact are recessed to form the recessed portions 113, and the recessed portions sweep toward the corner portions side and expand to protrude outward, thereby forming the protruding portions 112. In such a press-fit portion 11, the main body portion 10 having the shoulder portions 101 on the other end side of the rod-shaped base material, and the connection portion 12 can be integrally formed by forging a common base material. Note that the metal wire may be plated in advance with a highly conductive plating material such as tin, for example. Plating may also be performed after completion of the processing.

Figure 5:
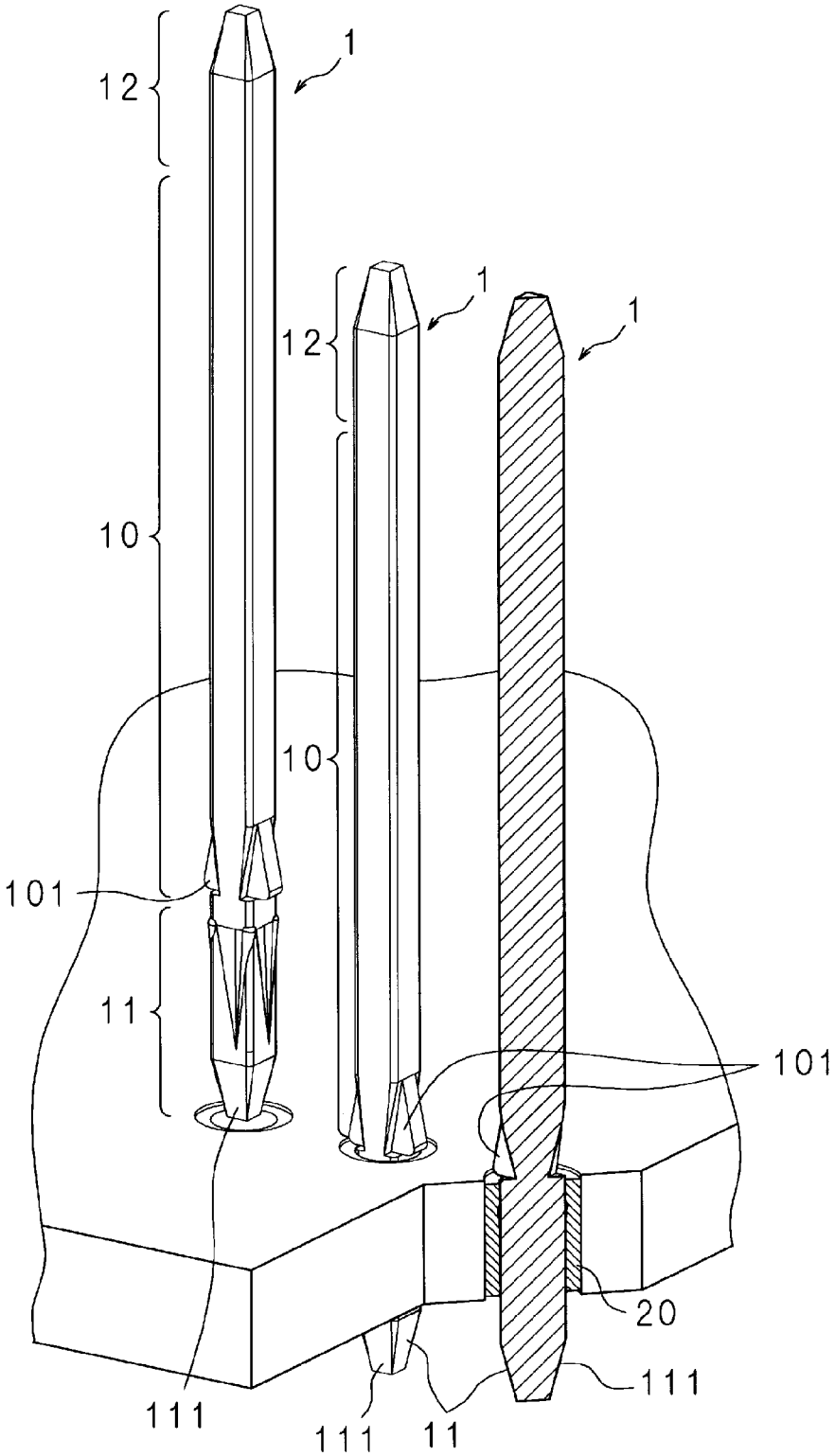
FIG. 5 is a perspective sectional view illustrating a press-fit state of the press-fit terminal according to the present disclosure.

FIG. 5 is a perspective sectional view illustrating a press-fit state of the press-fit terminal 1 according to the present disclosure. In FIG. 5, reference numeral 2 denotes a circuit board. The circuit board 2 includes a through hole 20 provided in an insulating substrate. The through hole 20 is a circular hole that passes through the substrate in the thickness direction and has an inner surface covered with a conductor, and is continuous with a conductor pattern formed on the substrate. The press-fit terminal 1 is used by press-fitting the press-fit portion 11 into the through hole 20.

The inside diameter of the through hole 20 of the circuit board 2 is, for example, 0.85 (±0.05) mm. In contrast, the press-fit portion 11 of the press-fit terminal 1 is manufactured by using a rod-shaped material having a length of a diagonal line of a cross section of about 0.80, that is, less than or equal to an inner diameter of the through hole 20, with a maximum size M of 0.95 (±0.05) mm as a target.

The press-fit portion 11 of the press-fit terminal 1 can be easily inserted into the through hole 20 using the tapered surfaces 111 formed at the distal end as a guide. The press-fit portion 11 is introduced into the through hole 20 by the tapered surfaces 111 without any resistance up to a position where a distance L from a cross-sectional center O of the outer edges of the protruding portions 112 matches half of the inner diameter of the through hole 20. When force is applied to the main body portion 10 of the press-fit terminal 1 in the length direction, the protruding portions 112 deform so as to collapse into the recessed portion therebetween and the press-fit portion 11 enters inside the through hole 20. The press-fit portion 11 is pressed until a reaction force against the pressing reaches a predetermined value. The press-fit terminal 1 cannot pushed further into the through hole 20, due to the function of the shoulder portions 101 as surface stoppers of the surface on the press-fit portion 11 side. The press-fit terminal 1 is pressed against the inner peripheral surface of the through hole 20 by the elastic restoring force of the protruding portions 112 of the press-fit portion 11 to be favorably in close contact therewith, and is firmly fixed by friction force.

As described above, the distance L from the cross-sectional center O of the outer edge of each of the protruding portions 112 is set so as to simply decrease continuously from the base portion toward the distal end of the press-fit portion 11, without varying. In the press-fit portion 11, because the protruding portions 112 bend and collapse into the recessed portions 113, the maximum length can be set to be sufficiently long with respect to the inner diameter of the through hole 20, and it is possible to avoid a situation in which the holding force is insufficient due to the maximum length being too small with respect to the inner diameter. Even when the maximum length is set long enough to the point of being excessive, the inner peripheral surface of the through hole 20 will not be unnecessarily damaged, due to the bending of the protruding portions 112, and the pushing of the press-fit portion 11 until the reaction force reaches a predetermined value. Further, because a straight line connecting the top portions of the respective cross sections of the protruding portions 112 is inclined with respect to the longitudinal direction, and the depth and width of the recessed portions 113 increases from the distal end toward the base portion, the protruding portions 112 easily bend on the base portion side with respect to the pressing force, and damage to the inner peripheral surface is reduced. This eliminates the need to strictly control both the through hole 20 of the circuit board 2 and the protruding portions 112 of the press-fit terminal 1. Therefore, the press-fit terminal 1 can be easily manufactured, and yield can also be improved.

The invention claimed is:

1. A press-fit terminal comprising a press-fit portion to be press-fitted into a through hole of a circuit board, wherein the press-fit portion includes a plurality of protruding portions extending outward from a cross-sectional center of the press-fit portion, a distance between an outer edge of each of the protruding portions and the cross-sectional center is continuously decreased toward a distal end of the press-fit portion, wherein a ridge line of the protruding portions is in a twisted position with respect to an axis of the press-fit portion.

2. The press-fit terminal according to claim 1, wherein a cross section of the press-fit portion on a distal end portion side has a polygonal shape corresponding to the number of protruding portions.

3. The press-fit terminal according to claim 1, wherein the cross section of the press-fit portion is cross-shaped on a base end side and substantially square on the distal end side.

4. The press-fit terminal according to claim 1, wherein the protruding portions are formed between recessed portions that increase in depth and width from the distal end toward a base portion of the press-fit portion.

5. The press-fit terminal according to claim 2, wherein the cross section of the press-fit portion is cross-shaped on a base end side and substantially square on the distal end side.

* * * * *